United States Patent [19]

Hodes

[11] 4,205,124

[45] May 27, 1980

[54] LOW GAMMA PHOTOGRAPHIC DEVELOPER

[75] Inventor: Harvey A. Hodes, Eatontown, N.J.

[73] Assignee: The United States of America as represented by the Secretary of the Air Force, Washington, D.C.

[21] Appl. No.: 3,056

[22] Filed: Jan. 12, 1979

Related U.S. Application Data

[63] Continuation of Ser. No. 876,444, Feb. 9, 1978, abandoned.

[51] Int. Cl.[2] ..... G03C 5/30; G03C 5/38

[52] U.S. Cl. ..... 430/456; 430/481

[58] Field of Search ..... 96/61 R, 61 M, 66 HD, 96/66.1, 66.4, 95, 59, 29 R

[56] References Cited

U.S. PATENT DOCUMENTS

| | | | |
|---|---|---|---|
| 3,573,912 | 4/1971 | Brown | 96/61 R |
| 3,615,513 | 10/1971 | Haist | 96/61 M |
| 3,632,341 | 1/1972 | Zacchia | 96/66 HD |
| 3,772,019 | 11/1973 | Holden | 96/66.1 |
| 3,839,046 | 10/1974 | Gent et al. | 96/66 HD |
| 3,870,479 | 3/1975 | Kubotera et al. | 96/66.4 |

FOREIGN PATENT DOCUMENTS

| | | | |
|---|---|---|---|
| 906034 | 9/1962 | United Kingdom | 96/61 M |

OTHER PUBLICATIONS

Mason, Photographic Processing Chemistry, 1975, pp. 42–43.

Zonars, "New Low-Contrast Developer for Rapid Processing of Aerial and Duplicating Films", Jul. 1963.

*Primary Examiner*—Mary F. Kelley

*Attorney, Agent, or Firm*—Joseph E. Rusz; Cedric H. Kuhn

[57] ABSTRACT

A photographic developer composition containing Phenidone and hydroquinone in a 1 to 2 weight ratio, the composition having a gamma less than 1 and a pH in the range of about 9.8 to 10.4. The composition is particularly useful as an extended range developer for rapid processing of aerial film.

4 Claims, No Drawings

LOW GAMMA PHOTOGRAPHIC DEVELOPER

RIGHTS OF THE GOVERNMENT

The invention described herein may be manufactured or used by or for the government of the United States for all governmental purposes without the payment of any royalty.

This is a continuation, of application Ser. No. 876,444, filed Feb. 9, 1978, now abandoned.

FIELD OF THE INVENTION

This invention relates to a low gamma photographic developer for the rapid processing of aerial film.

BACKGROUND OF THE INVENTION

It is well known that use of low gamma photographic developers result in certain advantages in aerial surveillance. Included among the advantages are simplification of camera design since the need for automatic exposure control is greatly reduced, reduction in overexposure errors, and compression of the density range of the negative to fit the density range of the positive image to be produced. From a practical standpoint, the choice between high or low contrast aerial photography is dependent upon the particular situation and the information desired. At high altitude, a high contrast (high gamma) developer is needed to detect small variations in luminance and to compensate for scattering and flare. At low and medium altitudes, the fundamental advantages of low contrast (low gamma) developers are increased resolution due to finer grain development and a wider exposure latitude. Since aerial reconnaissance is in many instances concerned with low and medium latitude photography, there is a real need for an improved low gamma developer.

The patent literature is replete with disclosures of formulations for use as photographic developers. Examples of such patents include U.S. Pat. Nos. 3,804,624 and 3,865,591. These patents are considered to be pertinent to the invention disclosed herein since they describe formulations containing Phenidone (1-phenyl-3-pyrazolidone) and hydroquinone, ingredients of the developer composition of this invention. However, according to U.S. Pat. No. 3,804,624, addition of Phenidone to silver halide emulsions was unsuccessful since the accelerator compound is very susceptible to oxidation. In U.S. Pat. No. 3,865,591, a developer formulation is disclosed that contains three developing agents, namely, 3-pyrazolidones (Phenidone), dihydroxybenzenes (hydroquinone), and enediols. In examples of the patent, formulations are disclosed in which the amount by weight of hydroquinone used is more than ten times the amount of Phenidone. Such a high weight ratio of hydroquinone to Phenidone is incapable of providing a low gamma photographic developer.

It is a principal object of this invention, therefore to provide an oxidatively stable, low gamma photographic developer.

Another object of the invention is to provide a low gamma photographic developer which is especially adapted for the rapid processing of aerial film.

Other objects and advantages of the invention will become apparent to those skilled in the art upon consideration of the accompanying disclosure.

SUMMARY OF THE INVENTION

The present invention resides in the discovery that a 1 to 2 weight ratio of 1-phenyl-3-pyrazolidone (Phenidone) to hydroquinone is critical in providing a low gamma developer composition. The actual amounts of the aforementioned developing agents used depends upon the volume of the developer composition that is formulated. Thus, the developer composition of this invention comprises 1 gram of Phenidone, 2 grams of hydroquinone, and sufficient water to make one liter, the composition having a gamma less than one and a pH ranging from about 9.8 to 10.4. The gamma value of the composition usually ranges from about 0.35 to 0.95 while the pH of the composition is preferably in the range of about 10.2 to 10.4. Use of the developer composition makes it possible to obtain unexpectedly improved film processing rates. Furthermore, the developer is stable at elevated temperatures for extended periods of time.

In one embodiment, the present invention resides in a developer composition having a pH in the range of 10.2 to 10.4 and comprising the following ingredients in the amounts indicated per liter of composition:

Phenidone—1 gram
Hydroquinone—2 grams
Sodium Carbonate—10 grams
Sodium Sulfite—30 grams In the foregoing developer composition, the Phenidone and hydroquinone in the critical 1 to 2 weight ratio functions as developing agents. The composition is further characterized by the low concentration of the developer moiety. The sodium carbonate acts as a pH buffering agent while the sodium sulfite is a preservative agent for the developers. The formulation is particularly adapted for use in conventional processing, employing a stop bath and fix.

The following are variations of the above formulation, (designated A and B) that are readily adapted to monobath processing:

| | A | B |
|---|---|---|
| Phenidone | 1 gram | 1 gram |
| Hydroquinone | 2 grams | 2 grams |
| Sodium Carbonate | 10 grams | 40 grams |
| Sodium Sulfite | 30 grams | 30 grams |
| Sodium Thiosulfate | 50 grams | — |
| Polyethylene oxide | 4 grams | — |
| Cysteine hydrochloride | — | 10 grams |

Each of the developer compositions contain sufficient water to make one liter. Formulation A has a pH of 10.2 to 10.4 while the pH of formulation B is from 9.8 to 10.0. The ingredients in the formulations common to those of the formulation set forth in the preceding paragraph perform the same function as indicated in that paragraph. In formulation A the polyethylene oxide serves a dual role, primarily as a development accelerator and secondarily as a protective colloid to reduce the adherence of sludge to processor walls. The sodium thiosulfate is the conventional silver complexing agent in monobath formulations. In formulation B the cysteine hydrochloride is another complexing agent which has the advantage of minimal sludge formation so that it is unnecessary to include the polyethylene oxide used in formulation A. However, since cysteine hydrochloride is an acid, it is necessary to increase the quantity of sodium carbonate to neutralize the acid and obtain the equivalent buffering capacity as in the other formulation.

A more comprehensive understanding of the invention can be obtained by referring to the following illustrative examples which are not intended, however, to be unduly limitative of the invention.

EXAMPLE I

A run was conducted in which Plus X Aerographic 2402 film was processed in Kodak Versamat processor, model 5A-N. The following developer composition of this invention was utilized: p1 Phenidone—1 gram
Hydroquinone—2 grams
Sodium Carbonate—10 grams
Sodium Sulfite—30 grams
Water to make 1 liter
pH—10.2-10.4

A control run was also carried out under the same conditions, using Kodak MX 641 developer.

The results obtained in the run are shown below in Table I.

TABLE I

| | Invention Run | Control Run |
|---|---|---|
| Temp., °C. | 35 | 35 |
| Fog level | 0.08 | 0.08 |
| Gamma | 0.55 | 1.55 |
| Speed(1) | 160 | 160 |
| Processing rate, ft/min | 15 | 3.5 |

(1)Effective aerial film speed (EAFS) per ANSI PH 2.34-1969 for the processing conditions described in this publication.

From the foregoing data, it is seen that the processing rate when using the low gamma developer of this invention is nearly five times greater than that obtained with a commercially available developer. This increase in processing rate represents an important and unexpected improvement in the use of the present developer.

EXAMPLE II

A run was conducted to test the stability of the developer composition described in Example I in the Versamat processor. The results obtained originally and after 5 days exposure to air are shown below in Table II.

TABLE II

| | Original | After 5 days |
|---|---|---|
| Fog level | 0.08 | 0.08 |
| Gamma | 0.62 | 0.53 |
| Speed | 125 | 125 |
| pH | 10.2 | 10.15 |

The data in the above table demonstrate that the developer composition of this invention is oxidatively stable over an extended period of time. Of particular significance is the fact that there was a slight drop in gamma, i.e., from 0.62 to 0.52, even after the five day exposure to air.

EXAMPLE III

A test was conducted to determine the storage stability of the dry ingredients of the developer composition described in Example I when stored in a stoppered glass vial. The vial containing the ingredients was stored for 16 hours at 160° F., conditions comparable to those encountered in the storage of photographic equipment in the most severe desert environment. No change in gamma or speed was detected in a developer solution made from the packaged ingredients.

EXAMPLE IV

A series of runs was carried out in which the developer formulation described in Example I was used to develop various films in a hand processing operation. The films processed, the conditions used, and the results obtained are shown below in Table III.

TABLE III

| Film | Temp. °C. | Time, sec. | Gamma | Speed | Fog |
|---|---|---|---|---|---|
| Tri X aero- | 26.5 | 30 | 0.38 | 300-160 | 0.14 |
| graphite 2403 | 35 | 15 | 0.35 | 320-250 | 0.14 |
| Plus X | 26.5 | 30 | 0.32 | 125 | 0.34 |
| Pan 5062 | 35 | 15 | 0.35 | 160 | 0.34 |
| | 35 | 30 | 0.60 | 200 | 0.40 |
| Panatomic X | 26.5 | 30 | 1.0 | 40 | 0.08 |
| Aerial 3400 | 15 | 0.65 | 25 | 0.10 | |
| | 35 | 10 | 0.83 | 50 | 0.10 |
| | 35 | 15 | 0.88 | 50 | 0.10 |
| | 35 | 30 | 1.78 | 40 | 0.12 |
| Panatomic X | 26.5 | 30 | 0.58 | 50 | 0.30 |
| 5060 | 35 | 15 | 0.48 | 64-50 | 0.26 |
| | 35 | 30 | 0.85 | 100 | 0.32 |
| Plux X Aero- | | | | | |
| graphic 2402 | 35 | 30 | 0.60 | 160-125 | 0.10 |

EXAMPLE V

A series of runs was conducted in which various films were hand processed in a thiosulfate monobath. The following is the developer composition utilized in the runs:
Phenidone—1 gram
Hydroquinone—2 grams
Sodium Carbonate—10 grams
Sodium Sulfite—30 grams
Sodium Thiosulfate—50 grams
Polyethylene oxide grade 4000—4 grams
Water to make 1 liter
pH 10.2-10.4

The films processed, the conditions used, and the results obtained are shown below in Table IV.

TABLE IV

| Film | Temp, °C. | Time,min | Gamma | Speed | Fog |
|---|---|---|---|---|---|
| Tri X Aerogra- | 26.5 | 4.0 | 0.66 | 200 | 0.16 |
| phic 2403 | 35 | 3.0 | 0.90 | 320 | 0.24 |
| Plus X | 26.5 | 3.5 | 0.48 | 100 | 0.32 |
| Pan 5062 | 35 | 2.5 | 0.73 | 160 | 0.34 |
| Panatomic X | 26.5 | 1.5 | 0.68 | 32 | 0.08 |
| Aerial 3400 | 35 | 1.0 | 1.0 | 100 | 0.10 |
| Panatomic X | 26.5 | 2.0 | 0.45 | 10 | 0.34 |
| 5060 | 35 | 1.5 | 0.64 | 40 | 0.32 |

EXAMPLE VI

A series of runs was carried out in which various films were hand processed in a cysteine monobath. The following is the developer composition employed in the runs:
Phenidone—1 gram
Hydroquinone—2 grams
Sodium Carbonate—40 grams
Sodium Sulfite—30 grams
Cysteine Hydrochloride—10 grams
Water to make 1 liter
pH 9.8-10.0

The films processed, the conditions used, and the results obtained are set forth below in Table V.

TABLE V

| Film | Temp, °C. | Time,min | Gamma | Speed | Fog |
|---|---|---|---|---|---|
| Tri X Aerographic 2403 | 26.5 | 5.0 | 0.62 | 320 | 0.18 |
| | 35 | 3.5 | 0.73 | 500 | 0.22 |
| Plus X Pan 502 | 35 | 3.5 | 0.40 | 50 | 0.30 |
| | 26.5 | 2.5 | 0.63 | 125 | 0.30 |
| Panatomic X | 26.5 | 1.5 | 0.69 | 12 | 0.06 |
| Aerial 3400 | 35 | 1.0 | 0.78 | 40 | 0.08 |
| Panatomic X 5060 | 2.0 | 0.32 | 12 | 0.32 | |
| | 35 | 1.5 | 0.48 | 40 | 0.30 |
| Plus X Aerographic 2402 | 26.5 | 3.5 | 0.56 | 80–64 | 0.06 |
| | 35 | 3.0 | 0.72 | 160 | 0.06 |

As seen from the foregoing, the present invention provides a low gamma photographic developer which is eminently suitable for the rapid processing of aerial film. The developer composition is further characterized by being stable to oxidative degradation.

As will be evident to those skilled in the art, modifications of the present invention can be made in view of the foregoing disclosure without departing from the spirit and scope of the invention.

I claim:

1. A photographic developer composition for processing aerial-type film to a gamma less than 1, said composition consisting of 1 gram of 1-phenyl-3-pyrazolidone and 2 grams of hydroquinone as the sole developing agents, and sufficient water to make one liter, the composition also contains sufficient alkali to provide a pH ranging from about 9.8 to 10.4.

2. The composition according to claim 1 which further contains 10 grams of sodium carbonate and 30 grams of sodium sulfite and has a pH ranging from about 10.2 to 10.4.

3. The composition according to claim 1 which further contains 10 grams of sodium carbonate, 30 grams of sodium sulfite, 50 grams of sodium thiosulfate and 4 grams of polyethylene oxide and has a pH ranging from about 10.2 to 10.4.

4. The composition according to claim 1 which further contains 40 grams of sodium carbonate, 30 grams of sodium sulfite and 10 grams of cysteine hydrochloride and has a pH ranging from about 9.8 to 10.0.

* * * * *

UNITED STATES PATENT AND TRADEMARK OFFICE

CERTIFICATE OF CORRECTION

PATENT NO. : 4,205,124

DATED : May 27, 1980

INVENTOR(S) : Harvey A. Hodes

It is certified that error appears in the above-identified patent and that said Letters Patent are hereby corrected as shown below:

Col. 4, line 18, Aerial 3400 film, change Temp.°C. from "15" to -- 26.5 --, change Time,sec from "0.65" to -- 15 --, change Gamma from "25" to -- 0.65 --, change Speed from "0.10" to -- 25 --, and change Fog from " " to --0.10 --.

Col 5, line 7 change "Plus X Pan 502" to -- Plus X Pan 5062 --; and line 11, Panatomic X 5060 film, change Temp,°C. from "2.0" to -- 26.5 --, change Time,min from "0.32" to -- 2.0 --, change Gamma from "12" to -- 0.32 --, change Speed from "0.32" to -- 12 --, and change Fog from " " to -- 0.32 --.

Signed and Sealed this

*Twenty-first* Day of *October 1980*

[SEAL]

*Attest:*

SIDNEY A. DIAMOND

*Attesting Officer*

*Commissioner of Patents and Trademarks*